US008029207B2

(12) United States Patent
Schouten

(10) Patent No.: US 8,029,207 B2
(45) Date of Patent: Oct. 4, 2011

(54) BRUSH HEAD ASSEMBLY WITH A THREE-POSITION CONTROL VALVE

(76) Inventor: Pieter Schouten, Berkeley, CA (US)

( * ) Notice: Subject to any disclaimer, the term of this patent is extended or adjusted under 35 U.S.C. 154(b) by 965 days.

(21) Appl. No.: 11/421,528

(22) Filed: Jun. 1, 2006

(65) Prior Publication Data

US 2007/0280775 A1 Dec. 6, 2007

(51) Int. Cl.
*A46B 11/06* (2006.01)

(52) U.S. Cl. ..... 401/289; 401/280; 401/281

(58) Field of Classification Search ..... 401/280, 401/281, 289, 136, 268, 270; 251/208, 209, 251/310, 311; 300/3–5, 8
See application file for complete search history.

(56) References Cited

U.S. PATENT DOCUMENTS 545,769 A * 9/1895 Bowman ..... 251/209
2,676,848 A * 4/1954 Harwell, Sr. ..... 300/4
2,736,914 A * 3/1956 Ratliff ..... 401/281
3,271,809 A * 9/1966 Morawski ..... 401/42
5,316,264 A * 5/1994 Newman et al. ..... 251/150
5,452,961 A * 9/1995 Lu ..... 401/42
6,438,797 B1 * 8/2002 Thomas ..... 16/110.1

* cited by examiner

*Primary Examiner* — David J Walczak
(74) *Attorney, Agent, or Firm* — George R. McGuire; Bond Schoeneck & King

(57) ABSTRACT

A brush head device for cleaning an object with a cleaning fluid. The device includes a body assembly having an input port and a reservoir. The input port is configured to receive the cleaning fluid. The reservoir is configured to collect the cleaning fluid received by the input port. A valve assembly is disposed in the body member between the input port and the reservoir. The valve assembly includes a plurality of discrete flow control channels configured to regulate a flow of cleaning fluid between the input port and the reservoir. The valve assembly is actuatable between an OFF position and a plurality of discrete flow control positions. Each of the plurality of discrete flow control positions corresponds to one of the plurality of discrete flow control channels. A brush member is coupled to the body assembly and in fluidic communication with the reservoir. The brush member is configured to apply the cleaning fluid to the object.

20 Claims, 6 Drawing Sheets

BRUSH HEAD ASSEMBLY WITH A THREE-POSITION CONTROL VALVE

BACKGROUND OF THE INVENTION

1. Field of the Invention

The present invention relates generally to automotive cleaning equipment, and particularly to brush heads used to deliver a cleaning fluid to a surface of a vehicle.

2. Technical Background

According to current marketing estimates, there are over five hundred million motor vehicles currently operating around the globe. There are over fifteen million vehicles sold in the United States every year, and forty-four million vehicles sold world wide. Vehicle ownership is a necessity. Motorists depend on their vehicle to get them back and forth from work, shopping, and other events and activities. However, for most people, the purchase of a motor vehicle represents a major investment. Accordingly, most vehicle owners try to protect that investment by providing their vehicles with the best maintenance they can afford. Part of this maintenance includes cleaning the exterior of the vehicle to remove dust, road salt, and other road contaminants that may degrade the vehicle finish.

Automated car washes typically employ devices that meter the storage, release and mixture of concentrated soap into a water stream. These devices are commonly referred to as "sudsers." Sudsers generally include a connector for operably attaching a hose to one end thereof, a reservoir for storing concentrated soap, means through which the water stream must pass to mix the water and soap, and a nozzle for dispensing the water/soap mixture. A brush head, or other such applicators, may be connected to the nozzle to apply the cleaning fluid to the vehicle surface.

However, conventional brush heads and applicators have drawbacks associated with them. For example, conventional brush heads in fluid communication with a source of pressurized fluid have no convenient method for regulating the flow of water and/or cleaning solution. Typically, the user must stop cleaning, put the brush down, and walk over to a selection panel to regulate the flow. Of course, this wastes the user's time and often results in the user depositing more coins in the car wash than are needed.

What is needed is brush head that includes a valve for regulating the flow of water through the brush head itself. The ability to regulate the water flow is desirable because it prevents waste, and allows the user to select an appropriate amount of water flow in accordance with his needs.

SUMMARY OF THE INVENTION

The present invention addresses the needs described above. The present invention provides a brush head that includes a valve for regulating the flow of water through the brush head. The present invention allows the user to select discrete water flow settings in accordance with his needs.

One aspect of the present invention is directed to a brush head device for cleaning an object with a cleaning fluid. The device includes a body assembly having an input port and a reservoir. The input port is configured to receive the cleaning fluid. The reservoir is configured to collect the cleaning fluid received by the input port. A valve assembly is disposed in the body member between the input port and the reservoir. The valve assembly includes a plurality of discrete flow control channels configured to regulate a flow of cleaning fluid between the input port and the reservoir. The valve assembly is actuatable between an OFF position and a plurality of discrete flow control positions. Each of the plurality of discrete flow control positions corresponds to one of the plurality of discrete flow control channels being in fluidic communication with the input port and the reservoir. The brush member is configured to apply the cleaning fluid to the object.

In another aspect, the present invention is directed to a cleaning assembly for cleaning an object with a cleaning fluid. The device includes a body assembly including an input port and a reservoir. The input port is configured to receive the cleaning fluid. The reservoir is configured to collect the cleaning fluid received by the input port. A valve is disposed in the body assembly between the input port and the reservoir. The valve includes a low flow rate control channel and a high flow rate control channel. A valve control actuator is configured to adjust a position of the valve between the OFF position, a low flow rate position and a high flow rate position. The OFF position aligns the valve such that a water-tight seal is disposed between the input port and the reservoir. The low flow rate position aligns the valve such that the low flow rate control channel is in fluidic communication with the input port and the reservoir. The high flow rate position aligns the valve such that the high flow rate control channel is in fluidic communication with the input port and the reservoir. An application member is coupled to the body assembly and is in fluidic communication with the reservoir. The application member is configured to apply the cleaning fluid to the object. A handle member is configured to mate with the input port at a first handle end portion.

In yet another aspect, the present invention is directed to a cleaning assembly for cleaning an object with a cleaning fluid. The assembly includes a body assembly having a collar member, a fluid reservoir, and a cylindrical structural member disposed between the collar member and the reservoir. The collar member includes an input port disposed within a threaded female connector. The input port is configured to receive the cleaning fluid and the reservoir being configured to collect the cleaning fluid received by the input port. A valve is disposed within the cylindrical structural member. The valve includes a central chamber disposed along a central longitudinal axis of the valve and an annular chamber disposed at a radial distance from the central longitudinal axis. A valve control actuator is configured to rotate the valve between an OFF position, a low flow rate position and a high flow rate position. The high flow rate position provides a fluid path between the input port, the central chamber and the reservoir. The low flow rate position provides a fluid path between the input port, the annular chamber and the reservoir. The OFF position provides a water-tight seal between the input port and the reservoir. An application member is coupled to the body assembly and is in fluidic communication with the reservoir. The fluid application member is configured to apply the cleaning fluid to the object. A handle includes a fluid delivery channel and a threaded male connector configured to be rotatably inserted into the threaded female connector, whereby the fluid delivery channel is coupled to the input port.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
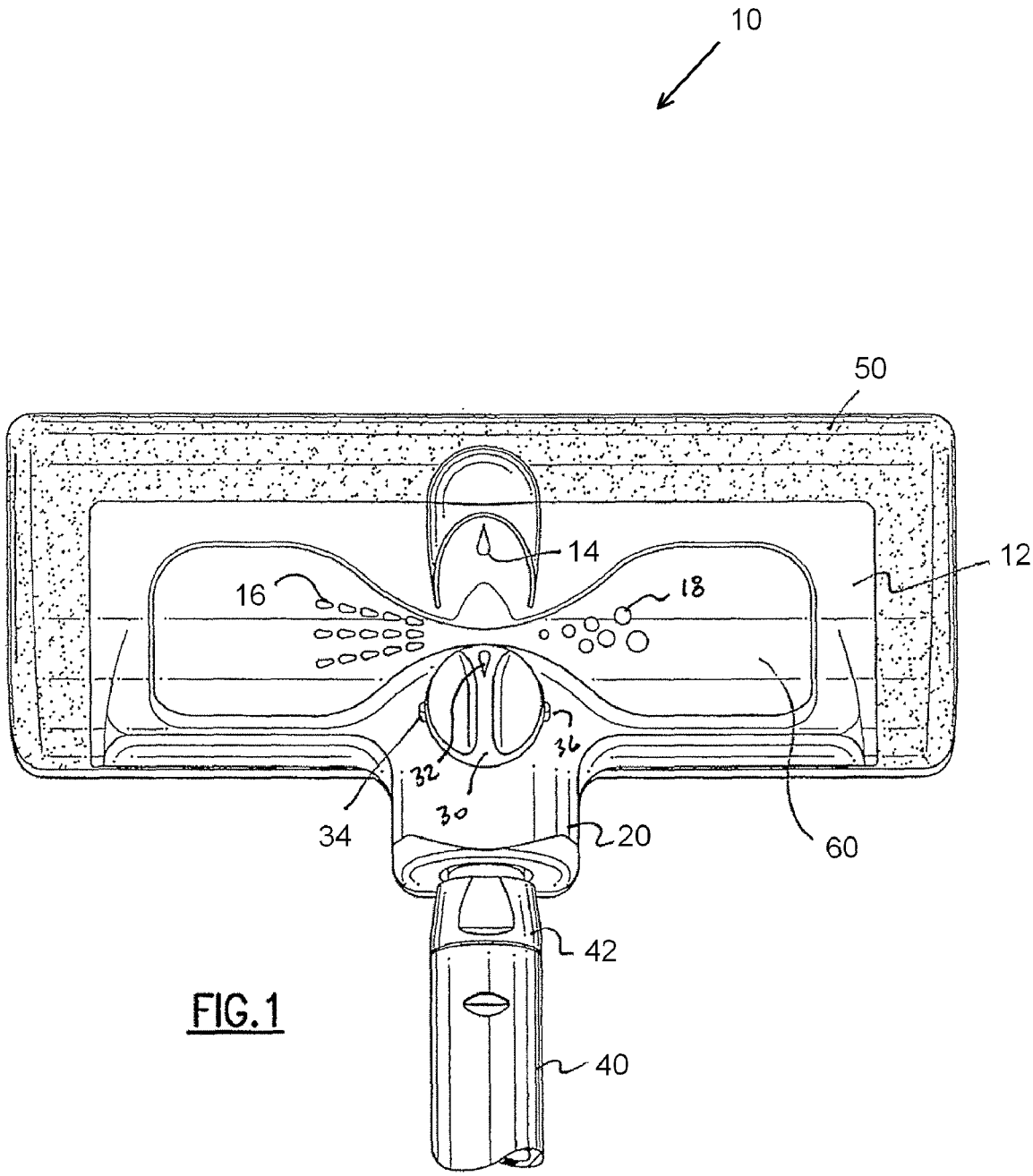
FIG. 1 is a top view of the brush head in accordance with the present invention.

Reference will now be made in detail to the present exemplary embodiments of the invention, an examples of which are illustrated in the accompanying drawings. Wherever possible, the same reference numbers will be used throughout the drawings to refer to the same or like parts. An exemplary embodiment of the brush head of the present invention is shown in FIG. 1, and is designated generally throughout by reference numeral 10.

As embodied herein, and depicted in FIG. 1, a top view of the brush head in accordance with the present invention is disclosed. Brush head 10 includes a body member 12 having a brush 50 attached thereto. Body member 12 includes an input port comprising an integrally formed collar 20. Collar 20 includes a threaded socket (not shown) that is configured to mate with brush handle 40. Handle 40 is configured to be coupled to a source of pressurized fluid (via a second connector, not shown) to thereby deliver fluid to the brush head for application to the surface being cleaned. A retaining cap 42 is disposed over the end of handle 40. The rate of fluid flow is controlled by a three-position valve (not shown in FIG. 1) disposed in body member 12.

Valve control knob 30 is mounted on collar 20 and is in operative communication with the three position valve. FIG. I shows control knob 30 in the OFF position. The user may rotate control knob 30 to adjust the setting of the valve between a high-flow rate setting 34, the OFF position, and the low-flow rate setting 36. Control knob 30 includes valve position indicia 32 to provide the user with a valve setting indicator. Accordingly, when valve position indicia 32 is aligned with setting 34, indicia 32 also points to indicia 16 to indicate that the valve is operating in a high-flow rate mode. When indicia 32 is aligned with setting 36, it also points in the direction of indicia 18 to indicate that the valve is operating in a low-flow rate mode. As noted above, when indicia 32 is aligned with indicia 14, the user understands that the valve is in the OFF position.

Figure 2:
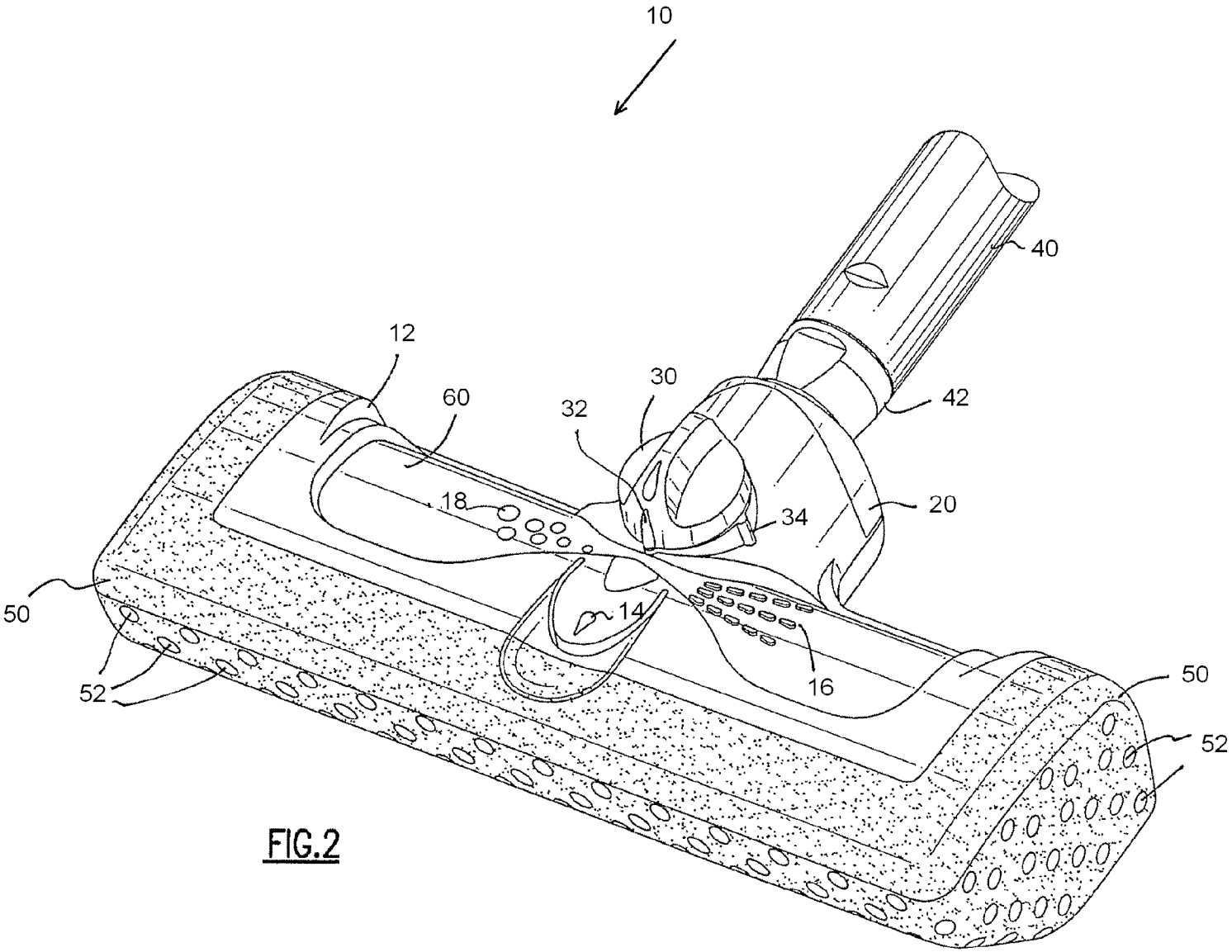
FIG. 2 is a front perspective view of the brush head depicted in FIG. 1.
Figure 3:
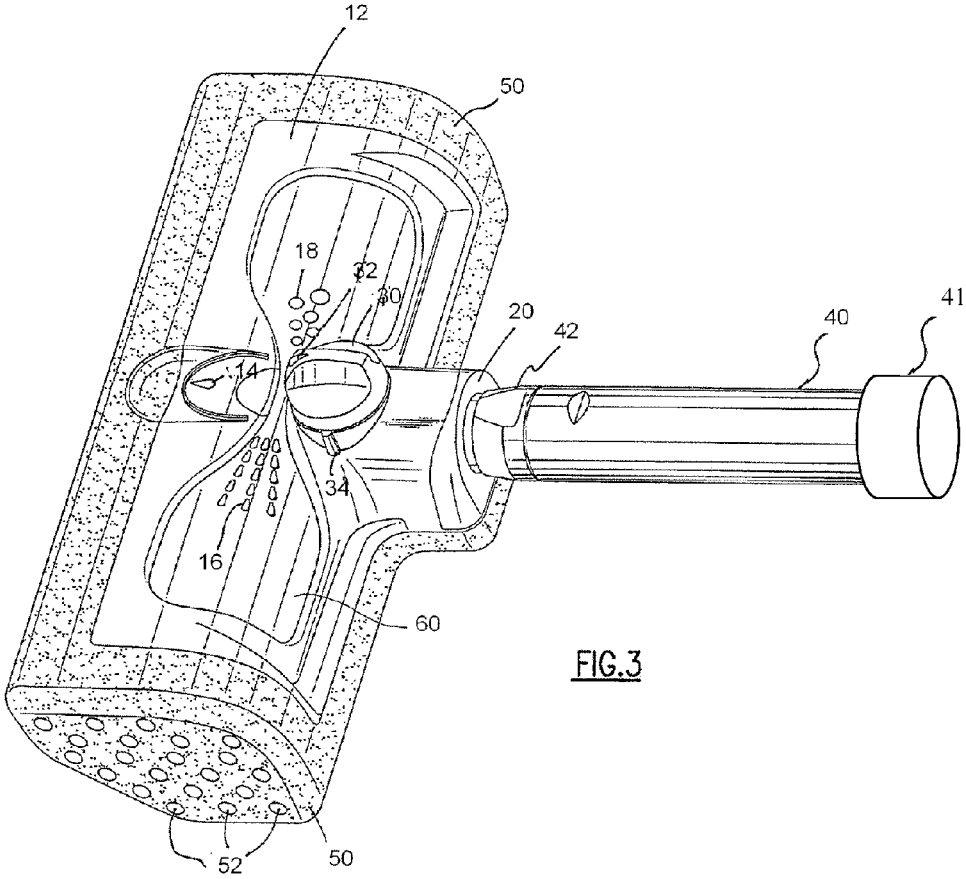
FIG. 3 is a side perspective view of the brush head depicted in FIG. 1.

FIG. 2 and FIG. 3 are alternate views of the brush head 10 depicted in FIG. 1. FIG. 2 is a front perspective view of brush head 10. FIG. 3 is a side perspective view of brush head 10. Each of these Figures feature sudsing capillaries 52 disposed in the sponge brush 50. The capillaries 52 are in communication with a fluid reservoir (not shown) disposed in body member 12.

Figure 4:
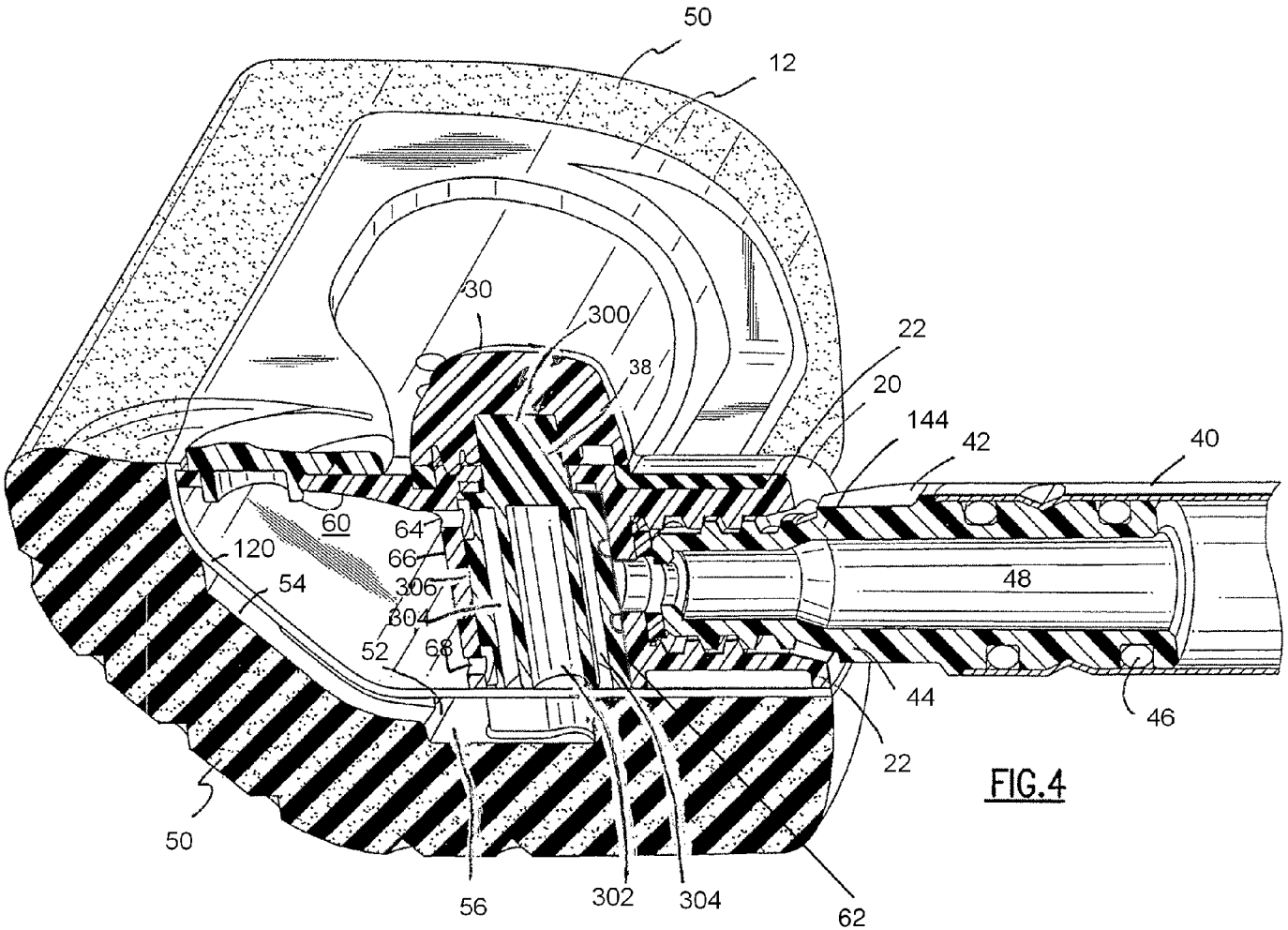
FIG. 4 is a cross-sectional view of the brush head in the OFF position.

Referring to FIG. 4, a cross-sectional view of brush head 10 in the OFF position is shown. Handle 40 includes a threaded connection nozzle 44. A fluid delivery tube 48 is disposed within both nozzle 44 and handle 40. Spring member 46 provides a tensile force that maintains the relative positions of nozzle 44 and handle 40. Threaded male nozzle 44 is configured to mate with the threaded female connection fitting 22 disposed within collar 20. Once nozzle 44 is rotated into place, the end of the nozzle abuts three-position valve 300.

FIG. 2 and FIG. 3 are alternate views of the brush head 10 depicted in FIG. 1. FIG. 2 is a front perspective view of brush head 10. FIG. 3 is a side perspective view of brush head 10. Each of these Figures feature sudsing capillaries 52 disposed in the sponge brush 50. The capillaries 52 are in communication with a fluid reservoir (not shown) disposed in body member 12. In FIG. 3, handle 40 shows a connection fitting 41 disposed its the distal end. Connection fitting 41 is preferably configured to be coupled to a source of cleaning fluid such that the fluid delivery channel 48 is in fluidic communication with a source of cleaning fluid.

Figure 5:
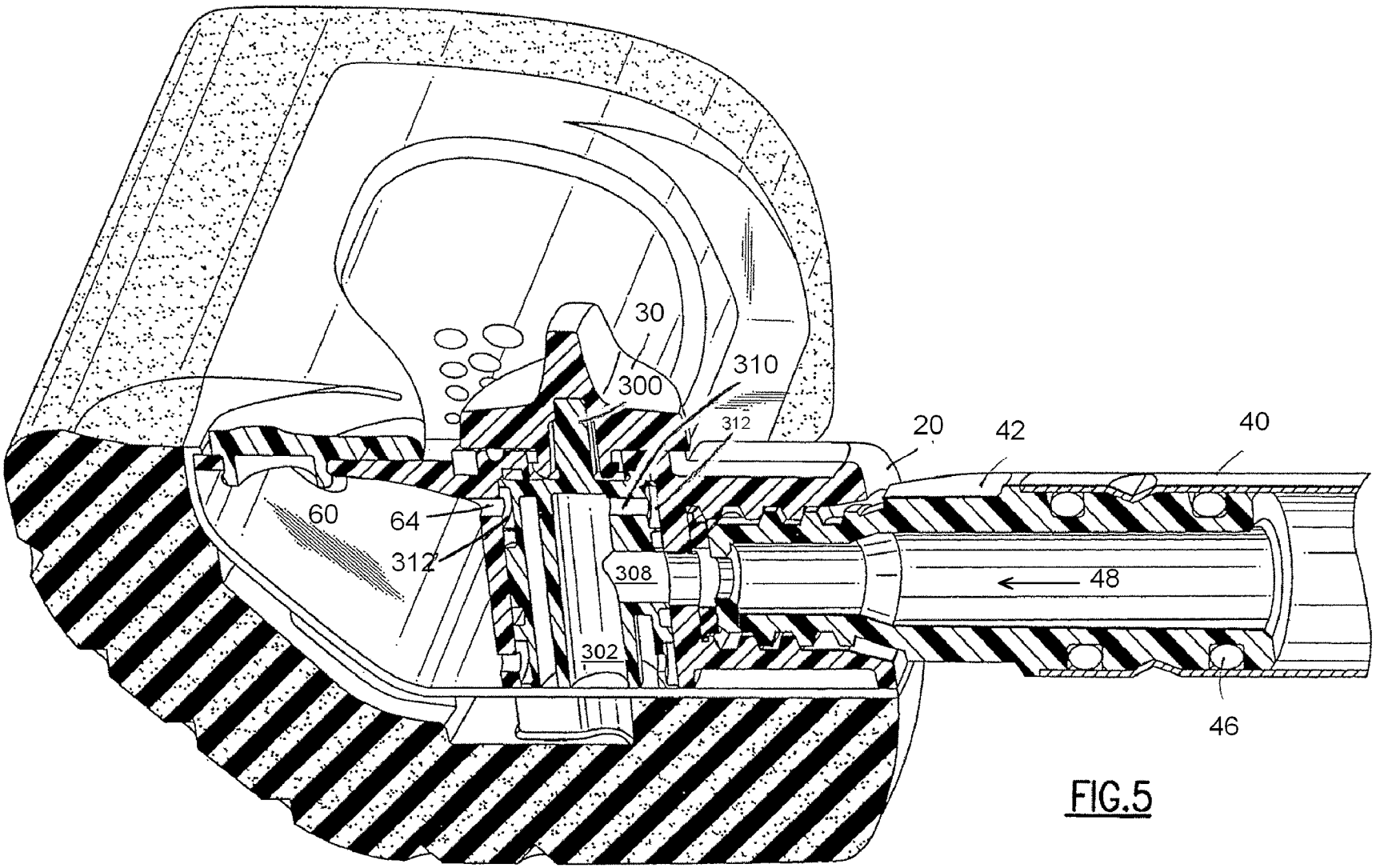
FIG. 5 is a cross-sectional view of the brush head in the HIGH water flow position.
Figure 6:
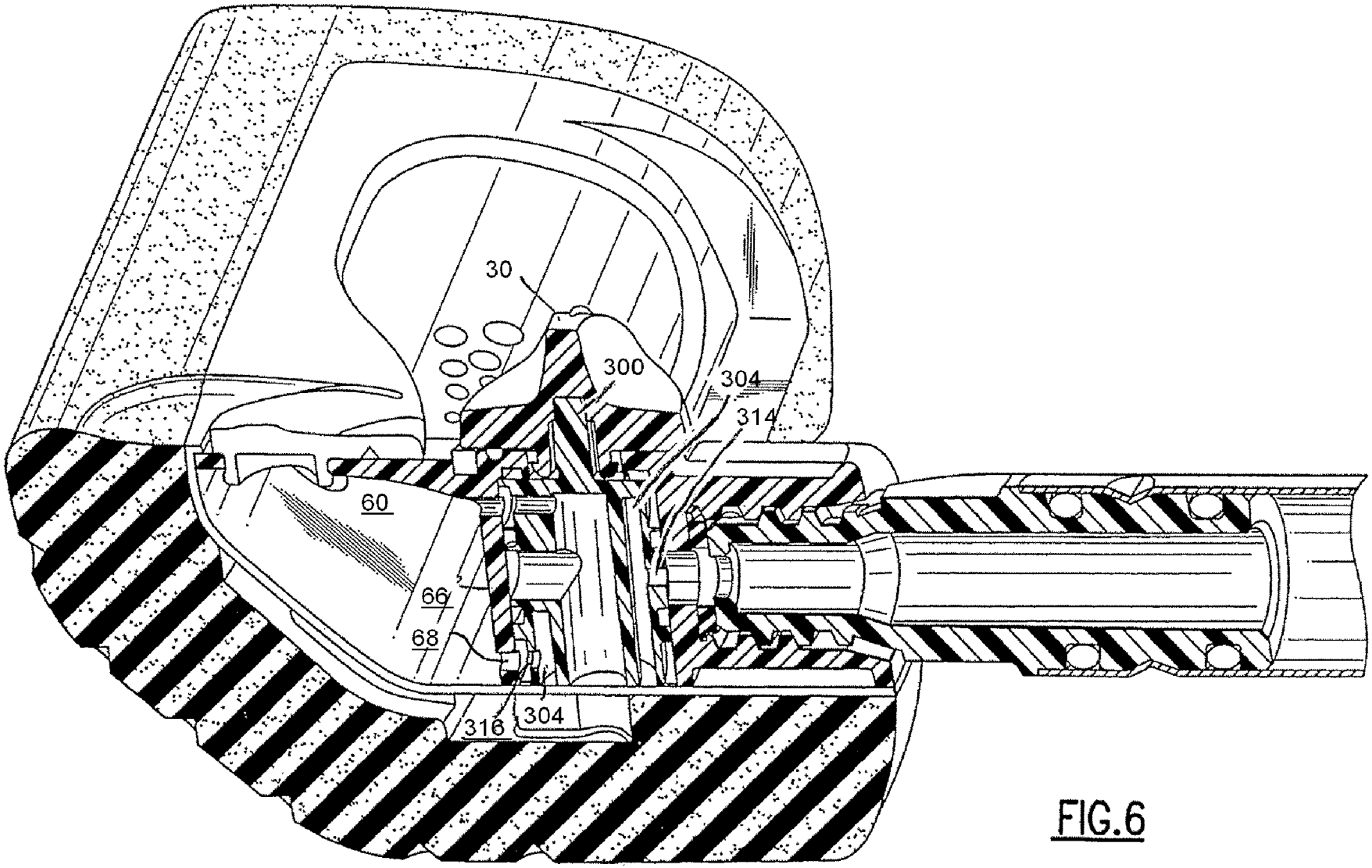
FIG. 6 is a cross-sectional view of the brush head in the LOW water flow position.

Valve 300 has a central cylindrical flow chamber 302 formed about the valve's longitudinal central axis. Valve 300 also includes an annular flow chamber 304 disposed a predetermined radial distance from the valve's central longitudinal axis. However, as shown in FIGS. 5 and 6, the annular chamber 304 only partially extends around cylindrical chamber 302. As noted above, FIG. 4 shows brush head 10 in the OFF position. Accordingly, valve 300 is positioned such that valve wall 306 seals the fluid delivery channel 48 disposed in handle 40. As such, no fluid may enter either central chamber 302 or annular chamber 304. Thus, in the OFF position valve provides a water-tight seal between the input port and the reservoir 60.

Reservoir 60 is formed by body member 12 and structural member 66. Body member 12 includes an exterior wall 120 that is shaped to provide the interior volume of reservoir 60. Structural member 66 includes an integrated upper plate and the cylindrical member that accommodates valve 300. The cylindrical member is disposed within the interior volume, whereas the upper plate member encloses the interior volume formed by body member 12. Reservoir 60 further includes weep holes (not shown) that are in fluidic communication with the sudsing capillaries 52 shown in FIGS. 1-3. Structural member 66 includes fluidic channels 64, 68. Channels 64, 68 allow fluids to be directed from valve 300 into reservoir 60.

The valve assembly, including the valve 300 and control knob 30, and the body assembly, which includes body 12 and structural member 66, may be fabricated from any suitable materials including metallic materials such as steel, aluminum, or metallic alloys, and/or suitable plastic materials.

Note that an upper portion of exterior wall 120 is connected to brush member 50 by an adhesive. Below that, adhesive pad 54 is disposed between wall 120 and brush 50. Pad 54 performs an important function. It creates a gap 56 between sponge 50 and wall 120. The fluids directed out of the reservoir weep holes (not shown) are collect in gap 56 until they are absorbed by sponge 50 and directed out of capillaries 52.

Those of ordinary skill in the art will understand that valve control mechanism of the present invention may be employed in other applicators as well as in the brush-head applicator described herein.

Referring to FIG. 5, a cross-sectional view of the brush head in the HIGH water flow position is shown. When control knob 30 is rotated in the clock-wise direction to high-flow setting 36 (See FIG. 1), valve 300 is likewise rotated to allow fluid to flow between handle delivery channel 48 and reservoir 60. In particular, note that central chamber 302 is connected to an intake port 308. When valve 300 is rotated in the clockwise direction, intake port 308 is aligned with fluid delivery channel 48. because the fluid is under pressure, it is directed into chamber 302 and follows the path provided by outflow port 310. The fluid is then directed into groove 312 formed in valve exterior wall 306. The clock-wise rotation of valve 300 also aligns fluidic channel 64 with groove 312. Thus, fluid begins to fill reservoir 60. Subsequently, the fluid is directed out of the reservoir weep holes, into gap 56, and out from sudsing capillaries 52.

Referring to FIG. 6, a cross-sectional view of the brush head in the LOW water flow position is shown. When control knob 30 is rotated in the counter-clock-wise direction to low-flow rate setting 34 (See FIG. 1), valve 300 is also rotated in the counter-clock-wise direction to allow fluid to flow between delivery channel 48 and reservoir 60. In particular, when valve 300 is thus rotated, intake port 314 is aligned with fluid delivery channel 48. The rotational movement also aligns outflow port 316 to reservoir intake channel 68. However, annular chamber 304 is connected to a smaller intake port 314 and the flow is thus restricted. Again, because the fluid is pressurized, it is directed into annular chamber 304. The fluid flows through annular chamber 304 and into reservoir 68, via the fluidic path formed by port 316 and channel 68. Again, the fluid begins to fill reservoir 60, albeit at a lower rate.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A brush head device for cleaning an object with a cleaning fluid, the device comprising:

a body assembly including an input port and a reservoir, the input port being configured to receive the cleaning fluid, the reservoir comprising an exterior wall and being configured to collect the cleaning fluid received by the input port, said exterior wall comprising a plurality of weep holes;

a valve assembly disposed in the body member between the input port and the reservoir, the valve assembly including a plurality of discrete flow control channels configured to regulate a flow of cleaning fluid between the input port and the reservoir, the valve assembly being actuatable between an OFF position and a plurality of discrete flow control positions, each of the plurality of discrete flow control positions corresponding to one of the plurality of discrete flow control channels being in fluidic communication with the input port and the reservoir;

a brush member coupled to the body assembly and in fluidic communication with the reservoir, the brush member being configured to apply the cleaning fluid to the object; and an adhesive pad disposed between said body assembly and said brush member, wherein said adhesive pad creates a gap between at least a portion of said reservoir exterior wall and at least a portion of said brush member.

2. The device of claim 1, further comprising a handle member that includes a first connector configured to mate with the input port at a first handle end.

3. The device of claim 2, wherein the input port further comprises a collar member that includes a female threaded connector, and wherein the first connector includes a male threaded connector, the male threaded connector being rotatably inserted into the female threaded connector to provide a substantially water-tight connection between the handle member and the input port.

4. The device of claim 1, wherein the body assembly further comprises:

a body member including a collar member and the reservoir, the collar member including a female threaded connector accommodating the input port; and a structural member disposed in the body member between the collar member and reservoir, the structural member including a cylindrical cavity and a plate member, the cylindrical cavity being configured to accommodate the valve assembly, the plate member being configured to enclose the reservoir.

5. The device of claim 4, further comprising a handle assembly, the handle assembly comprising:

an elongated handle including a fluid delivery channel disposed therein;

a threaded male connector disposed at a first end of the handle, the threaded male connector having at least a portion of the fluid delivery channel disposed therein and configured to be rotatably inserted into the female threaded connector to provide a substantially water-tight connection between a first end of the fluid delivery channel and the input port; and a second connector disposed at a second end of the handle, the second connector being configured to be coupled to a source of cleaning fluid such that the fluid delivery channel is in fluidic communication with the source of cleaning fluid.

6. The device of claim 4, wherein the valve assembly includes a valve disposed within the cylindrical cavity, the valve being rotatable within the cylindrical cavity between the OFF position and the plurality of discrete flow control positions.

7. The device of claim 6, wherein the plurality of discrete flow control positions includes a low flow rate position and a high flow rate position, and the plurality of discrete flow control channels including a low flow rate control channel corresponding to the low flow rate position and a high flow rate control channel corresponding to the high flow rate position.

8. The device of claim 4, wherein the valve assembly further comprises:

a valve disposed within the cylindrical cavity, the valve including a first chamber and a second chamber, the valve being rotatable within the cylindrical cavity; and a valve control actuator configured to rotate the valve within the cylindrical cavity to control the position of the first chamber and the second chamber relative to the input port and the reservoir.

9. The device of claim 8, wherein the valve control actuator rotates the valve between the OFF(position, a low flow rate position, and a high flow rate position, the OFF position aligning the valve such that a water-tight seal is disposed between the input port and the reservoir, the low flow rate position aligning the valve such that the first chamber is in fluidic communication with the input port and the reservoir, the high flow rate position aligning the valve such that the second chamber is in fluidic communication with the input port and the reservoir.

10. The device of claim 1, wherein the valve assembly further comprises:

a valve disposed in the body member between the input port and the reservoir, the valve including a first fluidic channel and a second fluidic channel; and a valve control actuator configured to rotate the valve between the OFF position, a low flow rate position and a high flow rate position.

11. The device of claim 10, wherein the OFF position aligns the valve such that a water-tight seal is disposed between the input port and the reservoir, the low flow rate position aligning the valve such that the first fluidic channel is in fluidic communication with the input port and the reservoir, the high flow rate position aligning the valve such that the second fluidic channel is in fluidic communication with the input port and the reservoir.

12. The device of claim 10, wherein the second fluidic channel further comprises:

a cylindrical flow chamber;

a second intake channel connected to the cylindrical flow chamber, the second intake channel being aligned with the input port when the valve is disposed in the high flow rate position; and a second outflow channel connected to the cylindrical flow chamber, the second outflow channel being aligned with a reservoir intake channel when the valve is disposed in the high flow rate position.

13. The device of claim 10, wherein the first fluidic channel further comprises:

an annular flow chamber disposed at a radial distance from a central longitudinal axis of the valve;

a first intake channel connected to the annular flow chamber, the first intake channel being aligned with the input port when the valve is disposed in the low flow rate position; and a first outflow channel connected to the annular flow chamber, the first outflow channel being aligned with a reservoir intake channel when the valve is disposed in the low flow rate position.

14. The device of claim 1, wherein the brush member includes fluidic capillaries in fluidic communication with the reservoir.

15. The device of claim 1, wherein the brush member is comprised of a sponge material.

16. The device of claim 1, wherein the body assembly is comprised of one or more materials selected from a group of materials that includes metallic materials and plastic materials.

17. The device of claim 1, wherein the valve assembly is comprised of one or more materials selected from a group of materials that includes metallic materials and plastic materials.

18. A cleaning assembly for cleaning an object with a cleaning fluid, the device comprising:

a body assembly including an input port and a reservoir, the input port being configured to receive the cleaning fluid, the reservoir comprising an exterior wall and being configured to collect the cleaning fluid received by the input port, said exterior wall comprising a plurality of weep holes;

a valve disposed in the body assembly between the input port and the reservoir, the valve including a low flow rate control channel and a high flow rate control channel;

a valve control actuator configured to adjust a position of the valve between the OFF position, a low flow rate position and a high flow rate position, the OFF position aligning the valve such that a water-tight seal is disposed between the input port and the reservoir, the low flow rate position aligning the valve such that the low flow rate control channel is in fluidic communication with the input port and the reservoir, the high flow rate position aligning the valve such that the high flow rate control channel is in fluidic communication with the input port and the reservoir;

an application member coupled to the body assembly and in fluidic communication with the reservoir, the application member being configured to apply the cleaning fluid to the object;

a handle member configured to mate with the input port at a first handle end portion; and an adhesive pad disposed between said body assembly and said application member, wherein said adhesive pad creates a gap between at least a portion of said reservoir exterior wall and at least a portion of said application member.

19. The assembly of claim 18, wherein the handle member includes connecting means configured to couple the handle member to a source of cleaning fluid at a second handle end portion.

20. A cleaning assembly for cleaning an object with a cleaning fluid, the assembly comprising:

a body assembly including a collar member, a fluid reservoir comprising an exterior wall, and a cylindrical structural member disposed between the collar member and the reservoir, the collar member including an input port disposed within a female threaded connector, the input port being configured to receive the cleaning fluid and the reservoir being configured to collect the cleaning fluid received by the input port, said exterior wall comprising a plurality of weep holes;

a valve disposed within the cylindrical structural member, the valve including a central chamber disposed along a central longitudinal axis of the valve and an annular chamber disposed at a radial distance from the central longitudinal axis;

a valve control actuator configured to rotate the valve between an OFF position, a low flow rate position and a high flow rate position, the high flow rate position providing a fluid path between the input port, the central chamber and the reservoir, the low flow rate position providing a fluid path between the input port, the annular chamber and the reservoir, the OFF position disposing a water-tight seal between the input port and the reservoir;

an application member in fluidic communication with the reservoir, the fluid application member being configured to apply the cleaning fluid to the object; and a handle including a fluid delivery channel and a threaded male connector configured to be rotatably inserted into the female threaded connector, whereby the fluid delivery channel is coupled to the input port; and an adhesive pad disposed between said body assembly and said application member, wherein said adhesive pad creates a gap between at least a portion of said reservoir exterior wall and at least a portion of said application member.

* * * * *